US007878028B2

(12) United States Patent
Jürgens et al.

(10) Patent No.: US 7,878,028 B2
(45) Date of Patent: Feb. 1, 2011

(54) KNITTING MACHINE TOOL, IN PARTICULAR FOR THE FINEST DIVISION

(75) Inventors: Eric Jürgens, Bisingen (DE); Andreas Dietz, Geislingen (DE); Uwe Stingel, Meßstetten (DE); Torsten Butz, Meßstetten (DE); Klaus Kirchmair, Nusplingen (DE); Eckhard Fehrenbacher, Tübingen (DE)

(73) Assignee: Groz-Beckert KG, Albstadt (DE)

( * ) Notice: Subject to any disclaimer, the term of this patent is extended or adjusted under 35 U.S.C. 154(b) by 22 days.

(21) Appl. No.: 12/149,584

(22) Filed: May 5, 2008

(65) Prior Publication Data

US 2008/0271497 A1 Nov. 6, 2008

(30) Foreign Application Priority Data

May 3, 2007 (EP) ..... 07008923

(51) Int. Cl.
*D04B 35/02* (2006.01)

(52) U.S. Cl. ..... 66/123; 66/116

(58) Field of Classification Search ..... 66/116, 66/120, 123, 114, 207, 208
See application file for complete search history.

(56) References Cited

U.S. PATENT DOCUMENTS 2,902,847 A * 9/1959 Kohl ..... 66/114
2,913,888 A * 11/1959 Amidon ..... 66/204
3,584,480 A * 6/1971 Zwingenberger et al. ..... 66/114
3,783,646 A * 1/1974 Naumann et al. ..... 66/120
3,823,581 A * 7/1974 Russo ..... 66/208
3,952,551 A * 4/1976 Kohl ..... 66/120
4,154,068 A * 5/1979 Hagel et al. ..... 66/121
4,157,690 A * 6/1979 Lund et al. ..... 112/226
4,571,961 A * 2/1986 Berger et al. ..... 66/208
4,603,561 A * 8/1986 Berger et al. ..... 66/203
4,643,004 A * 2/1987 Wunner ..... 66/208
5,373,710 A * 12/1994 Roth ..... 66/114

(Continued)

FOREIGN PATENT DOCUMENTS

CN 101008132 8/2007
DE 2004726 A * 8/1971 ..... 66/116
GB 2027757 A * 2/1980 ..... 66/114
GB 2099861 12/1982

*Primary Examiner*—Danny Worrell
(74) *Attorney, Agent, or Firm*—Fitch, Even, Tabin & Flannery; Norman N. Kunitz

(57) ABSTRACT

A knitting needle designed specifically for achieving particularly fine divisions, or another knitting tool (2), has a narrower working section (4) and a wider support section (5), whereby the support section (5) is provided with a positioning means (11), for example, having the form of a slit (12) or having the form of a rib (32). The knitting tool (2) is associated with a fixing means (29) in the form of a projection (17) or a groove (33) on the side of the bar (1). Due to this measure, the support sections (5) of the knitting tools (2) may be arranged—in close proximity to each other, in contact with or at a minimal distance from each other—on the bar (1), so that a maximum cross-section is available for configuring the support section (5). This provides strong stability for the knitting tools (2)—even in cases of extremely fine divisions—and, at the same time, provides precise alignment and avoids division errors.

9 Claims, 5 Drawing Sheets

U.S. PATENT DOCUMENTS 5,400,727 A * 3/1995 Neely ..... 112/80.45
5,442,936 A 8/1995 Berger et al.
5,544,501 A * 8/1996 Hagel ..... 66/124
5,666,826 A * 9/1997 Mista ..... 66/114
5,954,003 A * 9/1999 Beyer et al. ..... 112/80.45
6,925,841 B2 * 8/2005 Heydt, Jr. ..... 66/120

* cited by examiner 2
9
8
5
7
13
13
11
32
29, 33
1

2
30
16
Q
31
12
13b
35
13a
V
1
11, 29

2
16
13b
13a
35
12
1
30

36
23
16
20
19
22
13b
13a
20
18
26
5
31
19
21

KNITTING MACHINE TOOL, IN PARTICULAR FOR THE FINEST DIVISION

CROSS REFERENCE TO RELATED APPLICATION

This application claims the priority of European Patent Application No. 07 008 923.0, filed on May 3, 2007, the subject matter of which, in its entirety, is incorporated herein by reference.

BACKGROUND OF THE INVENTION

The invention relates to a tool, in particular to a knitting tool, for loading bars in textile machines, in particular of knitting machines. Hereinafter, a knitting tool is understood to mean a tool for the production of knit goods, in particular a knitting needle.

Textile machines, e.g., tufting machines, stitch-bonding machines or knitting machines comprise bars with tools for the production of flat textile structures. A tool in accordance with the invention may be held by a bar of such a machine or of a similar textile machine.

As a rule, textile machines comprise at least one bar that holds many knitting tools, e.g., needles, in parallel alignment with respect to each other. In so doing, the bar is an oblong carrier which extends in a direction transverse to the knitting tools and performs a pre-specified movement. In so doing, all of the knitting tools seated on the carrier perform the same movement.

The knitting tools are held on the bar at specific distances with respect to each other. These distances determine the division. A measurement for the division is the so-called fineness which is expressed in terms of the number of knitting tools per English inch. The fineness (gauge) E40 denotes 40 needles per English inch.

Usually, the bar has a slit for each knitting tool, whereby the knitting tool is held and clamped in place in said slit. Using this concept, a fineness or gauge of E40 to E44 can be achieved. Considering higher degrees of fineness, this concept has its limits. The strip walls and/or tool shafts present between the slits become so thin that they can no longer withstand the mechanical demands.

Considering this, it is the object of the invention to state an improved concept for knitting tools of knitting machines. Another object is to state a concept with which particularly high degrees of fineness can be achieved.

SUMMARY OF THE INVENTION

This object is achieved with the knitting tool in accordance with claim 1, as well as with the knitting machine in accordance with claim 2:

The knitting tool in accordance with the invention has, on its body, a positioning means with which said knitting tool can be positioned so as to be consistent with a pre-specified division. The positioning means makes unnecessary the strip walls to be provided between the knitting tools until now. Said positioning means positions the knitting tool on the bar, independent of strip walls or channels as were earlier required for the accommodation of tool shafts. As a result of this, the space used earlier for the strip walls is now available for the thickness of the knitting tool bodies or their tool shafts that create bearing sections. Extremely high degrees of fineness of, for example, E50 can be achieved, without any occurrence of the problems related to stiffness or strength of the knitting tools.

The positioning means provided on the knitting tool is disposed to bring the knitting tool into a specific position relative to said tool's transverse direction and to fix said tool in this position. The positioning means can be implemented as a suitable cutout, for example, a slit extending in longitudinal direction of the body. Then, this slit extends preferably around a strip or projection provided on the bar. This projection may be configured in one piece with the bar or it may, alternatively, be represented by a strip that is set into the bar. Viewed in cross-section, the knitting tool in this case has a U-profile in the region of the positioning means, said U-profile being disposed to seat the knitting tool on the projection. In so doing, the upper narrow side of the projection may be in contact with the slit bottom. Alternatively, the faces of the legs of the knitting tool may be seated on the bar on both sides next to the projection. The upper narrow side of the projection is then located at a distance from the base or bottom of the positioning means.

Referring to an alternative embodiment, the positioning means may be at least one projection provided on the body. For example, this projection may be represented by a rib extending in longitudinal direction on the body. Preferably, this rib is located on a narrow side of the body. The bar has a groove for the rib, said rib fitting into said groove. Preferably, several grooves are provided on the bar, said grooves being aligned parallel to each other and defining the division of the needles. The grooves are narrower than the tool shafts or support sections. Said grooves are used only for the accommodation of the ribs.

If the positioning means of the knitting tool is represented by a slit on the body, the strips provided on the bar determine the division of the knitting tools.

In neither of the two cases are there any spacers, slit walls or other elements provided between the knitting tools. Rather, the flat sides of adjacent knitting tools face each other. They limit narrow slits or abut against each other without appreciable pressure. Consequently, the entire distance of division between the tool shafts or support sections may be filled, whereby said tool shafts or support sections display a high degree of stiffness, even in instances of very fine divisions. In addition, the bodies may support each other in transverse direction, thus additionally contributing to the stiffness.

Preferably, in at least their region of the stitch-forming section, the knitting tools have a width that is smaller than the width of the support sections which are held on the bar. Here, width is understood to be the distance of the lateral surfaces of the respective support section or of the stitch-forming section in a direction transverse to the longitudinal direction relative to the knitting tool. The transverse direction extends parallel to the longitudinal direction of the bar. However, it is also possible to provide knitting tools having a stitch-forming section that has the same width as the support section or that is even slightly larger. This is possible when the bar is alternately loaded with knitting tools having stitch-forming sections of different spatial orientations, e.g., in that they alternately point diagonally upward and diagonally downward.

If the knitting tool is a needle, the stitch-forming section may have a shaft, for example, said shaft terminating in a hook at the end. The shaft may also have a uniform height or have different heights. In so doing, the height is measured perpendicular to the longitudinal direction of each needle. A slit, for example for a slider, may be provided in the shaft. Said slider may be held on another bar, whereby said slider may be configured in accordance with the same principle as the needle and may be held in the bar. The slider, the needles and any other elements used for forming stitches are thus knitting tools as defined by the patent claims.

Additional details of embodiments of the invention are the subject matter of the drawings, the description and the claims. The description is restricted to essential aspects of the invention and miscellaneous details. The drawings disclose additional details and are to be used as a supplementary reference.

DETAILED DESCRIPTION OF THE INVENTION

Figure 1:
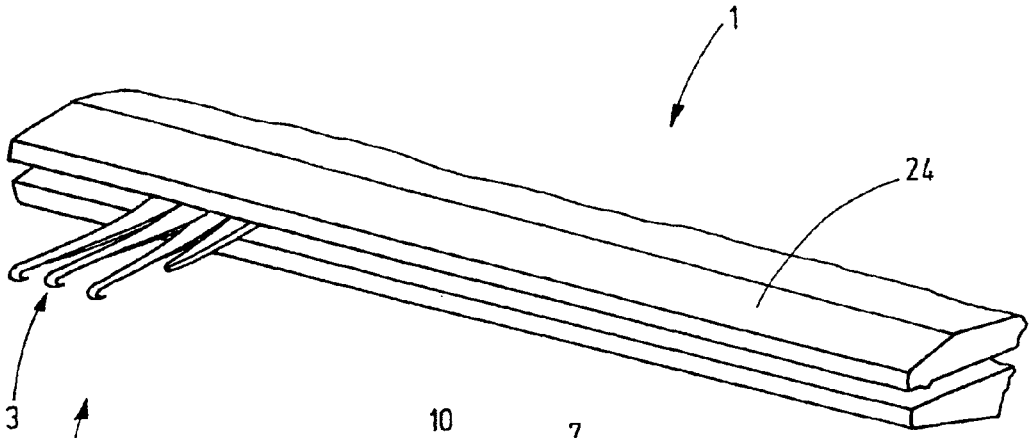
FIG. 1 is a detail of a general arrangement drawing of a bar with a few hooked needles.
Figure 2:
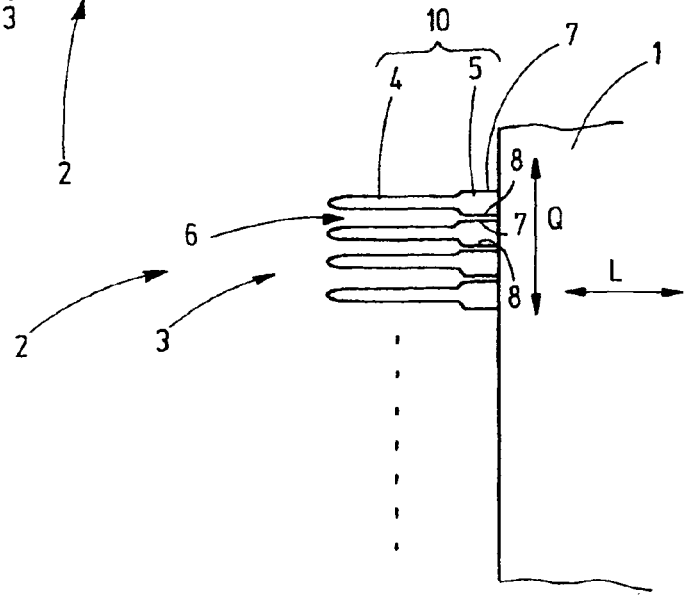
FIG. 2 is a plan view of the bar in accordance with FIG. 1.

FIG. 1 shows a bar 1 of a knitting machine. Knitting tools 2, in this case described with reference to the needles 3, for example, are shown. The needles 3 are held in parallel alignment next to each other. As is obvious from FIG. 2, each knitting tool 2 has a working section 4 and a support section 5. The working section 4 comprises a stitch-forming region, i.e., a stitch-forming section. As is obvious, the working sections 4 are narrower than the support sections 5, i.e., they are less wide. In so doing, the width is to be measured in the transverse direction Q, said direction corresponding to the longitudinal direction of the bar 1 and being at a right angle relative to the longitudinal direction L of each knitting tool. Due to the smaller width of the working sections 4, an adequate gap 6 or free space is available between the working sections 4 of adjacent knitting tools 2, even when the support sections 5 are very close to each other or when their flat lateral surfaces 7, 8 are in contact with each other.

Figure 3:
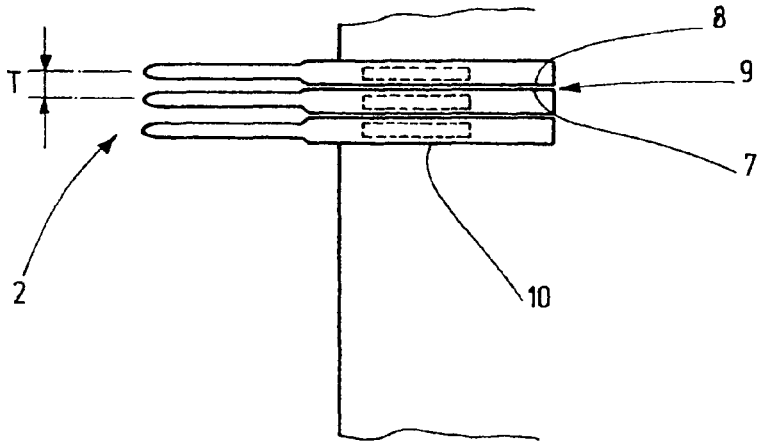
FIG. 3 is a plan view of the bar in accordance with FIG. 1, with the clamp strip removed.

As is indicated by FIG. 3, a narrow gap 9 may exist between adjacent lateral surfaces 7, 8. This gap may have a size in the region of a few micrometers up to approximately one tenth of a millimeter; optionally it may also be larger. Preferably, the gap 9 is empty, i.e., open. In the individual case it may also be practical to arrange additional elements in the gap, such as, for example, elastically or plastically resilient damping elements or the like. In any event, however, there are no elements in the gap 9 that would pre-specify or define the division of the knitting tools 2. The division is expressed by the center-to-center distance T of adjacent knitting tools 2. The higher (the gauge) or the greater the fineness E, the smaller the division T. In the present exemplary embodiment, the division T is, e.g., 0.5 mm (approximately E50). In order to maintain this division, the body 10 of the knitting tool 2 is provided with a positioning means, as is more readily obvious from FIG. 4. There, the positioning means 11 is represented by a cutout that is configured as a slit 12 and extends in the longitudinal direction L, said slit extending from the needle's upper side, one narrow side 13 of the support section 5, into the body 10. In so doing, the slit 12 is preferably restricted to the support section 5. The end-side working section 4 of the knitting tool 2 that is provided with a hook 14, for example, projects from the bar 1 and, as such, does not contain a positioning means. This section may be provided with a slit 15 which, for example, is disposed to accommodate a slider (not illustrated) and is thus part of the stitch-forming system.

For positioning of the knitting tools 2, the bar 1 has preferably a flat support surface 16 against which abuts the narrow side 13 of the support section 5. A projection 17 extends vertically from the support surface 16, said projection being represented by a strip 18 in the present exemplary embodiment. As is obvious from FIG. 5, this strip's width is preferably limited by two parallel flat sides 19, 20. The height of the strip is limited by two narrow sides 31, 36. The strip 18, e.g., is set in a groove 21 which is provided on the abutment surface 16 in the bar 1. In so doing, the narrow side 36 of the strip 18 interacts with the needle bar 1 and acts as an abutment surface for the strip 18. The slit 12 of the support section 5 of the knitting tool 2 extends around the strip 18. In so doing, the height of the strip 18 is selected in such a manner that its narrow side 31 facing away from the needle bar is arranged at a distance from the bottom 35 of the slit 12. The two flanks that limit the slit 12 and are configured as legs 22, 23, abut—preferably with minimal or no play—on the flat sides 19, 20 of the strip 18 and thus position the knitting tool 2 in a direction transverse to its longitudinal direction L. The narrow side 13 is divided by the slit 12 into two partial surfaces 13*a*, 13*b*, said partial surfaces abutting the support surface 16 and aligning the knitting tool 2 on the support surface 16.

Figure 4:
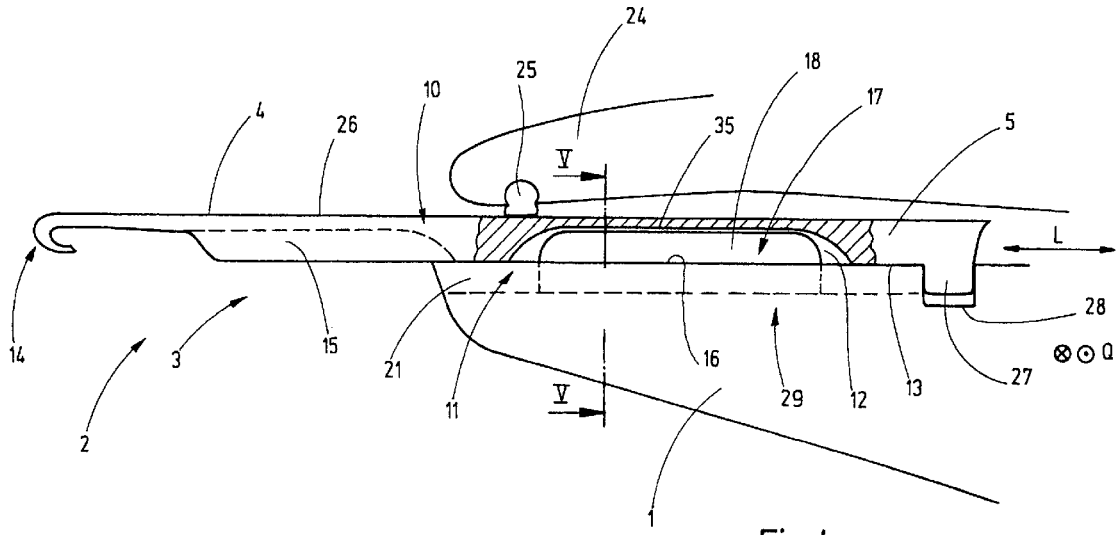
FIG. 4 is a vertical side view, partially in section, of the bar in accordance with FIG. 1.

As is additionally obvious from FIGS. 1 and 4, the knitting tools 2 are tensioned by means of a clamp strip 24 relative to the support surface 16. For example, the clamp strip 24 pushes—via a damping element—against the rear side, i.e., a narrow side of the knitting tool 2.

In addition, a foot 27 may be provided on the support section 5, said foot preferably extending away from the narrow side 13 of the support section 12 that has the slit 12. The foot 27 fits in an axial positioning groove 28 which extends in transverse direction Q along the bar 1.

The positioning means 11 in the form of the groove 12 extends over a large part of the support section 5. Instead of the single parallel-flanked slit 12, it is also possible to provide two short sequential slits that are associated with correspondingly smaller projections 17 (not illustrated). In addition, the slit 12 need not necessarily have parallel flanks. Instead of the rectangular cross-section, the slit 12 and the strip 18 may also have deviating cross-sections, e.g., trapezoidal cross-sections. Their dimensions relative to each other may be determined in such a manner that the flanks of the slit 12 are slightly elastically deformed by the strip 18, e.g., they are bent away from each other. In this way, the support section is positioned entirely without play. As a result of the elasticity of the slit walls, a compensation of manufacturing tolerances is possible.

Furthermore, as shown by FIG. 4, the contour of the strip 18 is preferably smaller than the slit 12 in order to simply take over the lateral guidance or partial positioning of the knitting tool 2, while axial positioning is achieved exclusively by the foot 27. The projection 17 is arranged on the bar 1 in exact division. However, said projection represents, in each of the said modifications, a fixing means 29 for fixing the needle division or knitting tool division.

The adjustment of the appropriate division thus is achieved by the interplay between the positioning means 11 and the fixing means 29. A series of additional modifications—a few of them being mentioned as examples hereinafter—may be taken into consideration for said means.

Figures 5, 6, 7, 8:
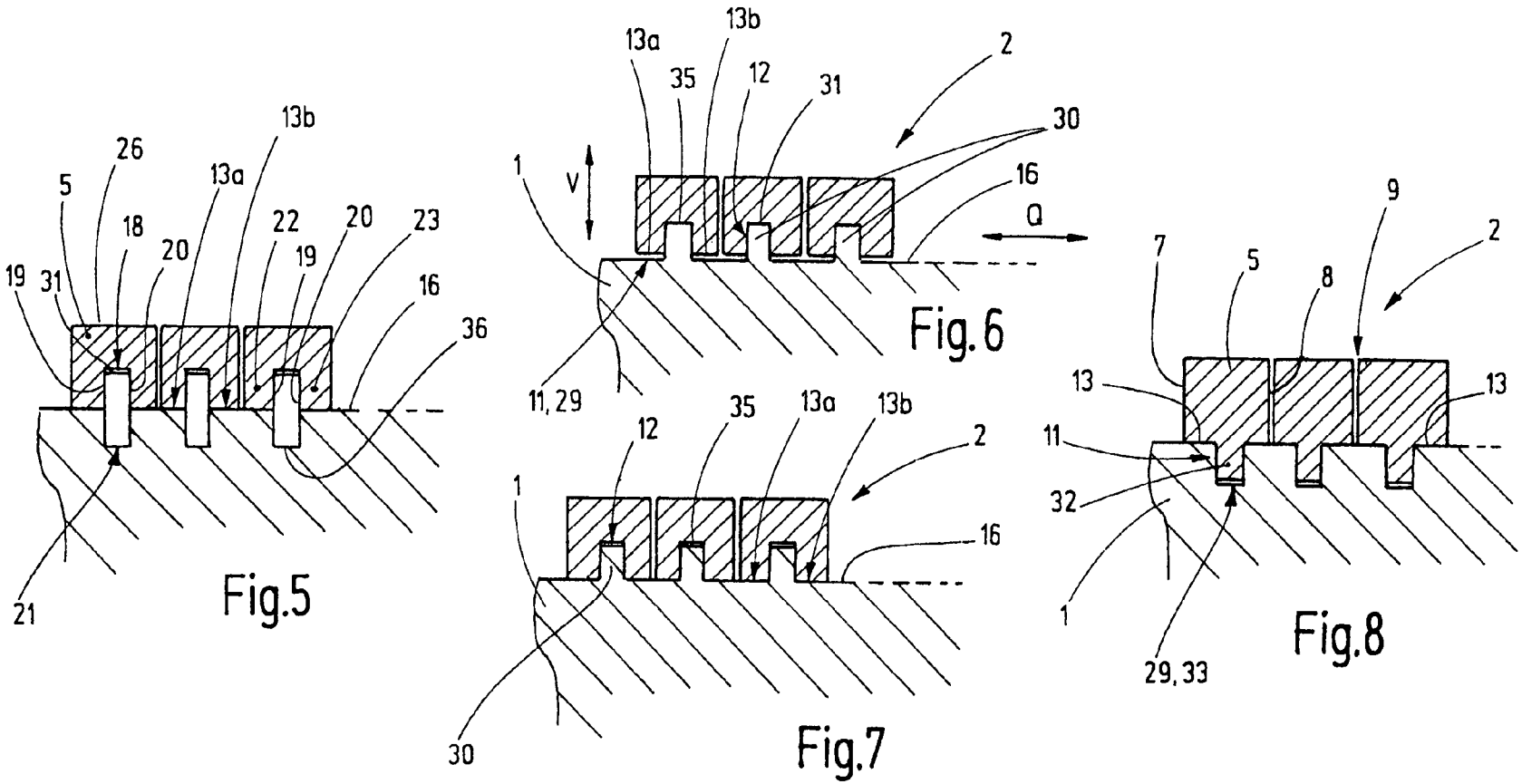
FIG. 5 is a sectional view, along line V-V, of the bar in accordance with FIG. 4.
FIG. 6 is a modified embodiment of the bar and the needles corresponding to the sectional view of FIG. 5.
FIG. 7 shows another embodiment of the bar corresponding to the sectional view of FIG. 5.
FIG. 8 is a sectional view in accordance with FIG. 5 of an alternative embodiment of the knitting tools and the bar.

As is shown by FIG. 6, the fixing means 29 may also be represented by strip-like projections 30 that extend upward from the support surface 16 of the bar 1 and are part thereof. For example, the projections 30 are connected seamlessly in one piece with the bar 1. Said projections may have been created in that the material originally present between them is removed in order to create the support surface 16. The projections 30 may have, parallel to the support surface 16, an end-side narrow side in the form of a strip-shaped positioning surface 31 which is in abutment with the bottom 35 of the slit 12. In this case, the partial surfaces 13*a*, 13*b* are not in contact with the support surface 16, but float at a minimal distance above said support surface. As a result of the interaction of the bottom 35 of the knitting tool 2 with the positioning surface 31 of the projection 30 of the bar 1, the height of the hook 14 of the working section 4 of the knitting tool 2 is fixed. In order to produce high-quality knit goods it is necessary that this working height be identical for all installed knitting tools 2 of a needle bar 1. Referring to the exemplary embodiment in accordance with FIG. 6, a uniform height of all positioning surfaces 31 of a bar 1 can be achieved with simple known fabrication means, e.g., by machining (grinding or milling), in that these positioning surfaces are machined together in one process step. In this case, the positioning of the knitting tool 2 is specified with respect to fixing the division, i.e., in transverse direction Q, as well as with respect to the vertical direction V by positioning means 11 and fixing means 29.

The dimensions of the strip 18 in accordance with FIG. 5 can be defined in such a manner that the working height of the hook 14 is fixed as in the exemplary body in accordance with FIG. 6. Then, the positioning surface 31 of the strip 18 interacts with the bottom 35 of the slit 12, is in contact with said slit and thus defines the height of the working section 4. The support surface 16 of the bar 1 is then located at a distance from the narrow side 13 of the knitting tool 2.

In accordance with FIG. 7 it is also possible—with an otherwise equal configuration of the bar 1 and the knitting tools 2 in accordance with FIG. 6—to dimension the projections 30 with respect to the size of the slits 12 in such a manner that the partial surfaces 13*a*, 13*b* abut against the support surface 16. The end-side limitation of the projection 20, i.e., the narrow side 31, is then located at a distance from the bottom 35 of the slit 12. The support surface 16 is then used for positioning the knitting tools 2, in particular for positioning the stitch-forming section 4. As a result of the interaction of the lower narrow side 13 of the knitting tool 2 with the support surface 16 of the bar 1, the height of the hook 14 of the working section 4 of the knitting tool 2 is fixed. In the ideal case, this working height is identical for all knitting tools 2 that are used in a needle bar.

Figure 9:
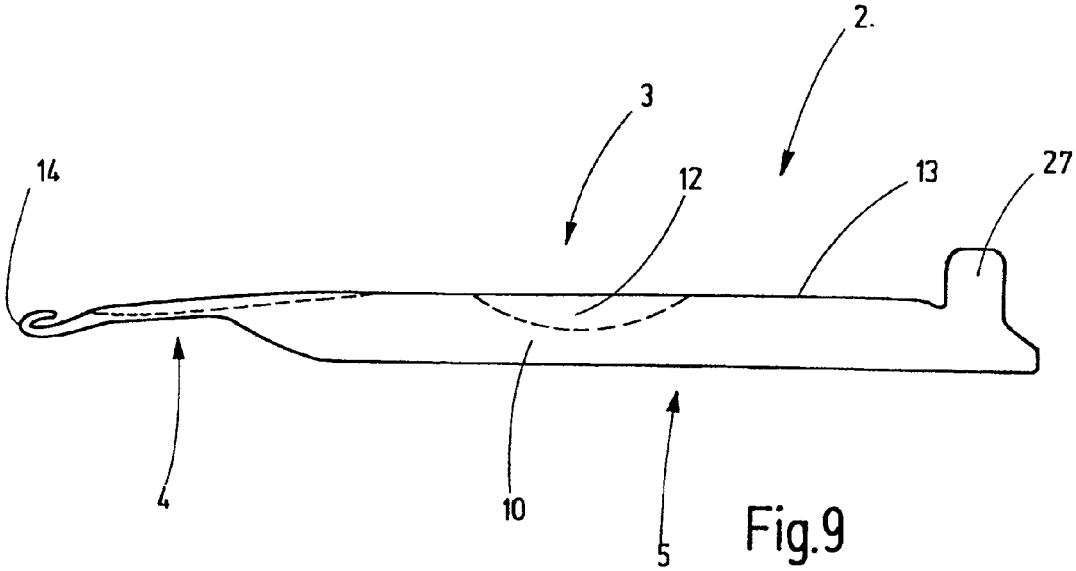
FIG. 9 is a side view of a modified embodiment of a needle in accordance with the invention.
Figure 10:
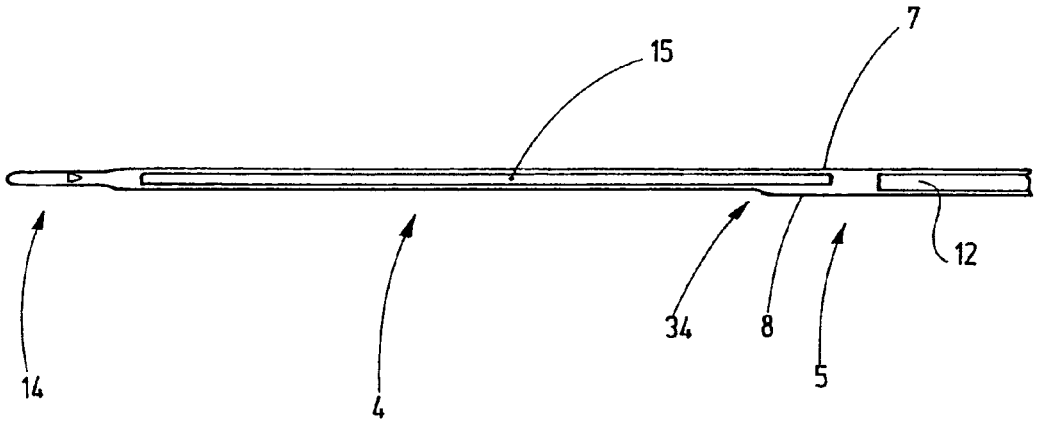
FIG. 10 is a plan view of the inventive needle in accordance with FIG. 9.
Figure 11:
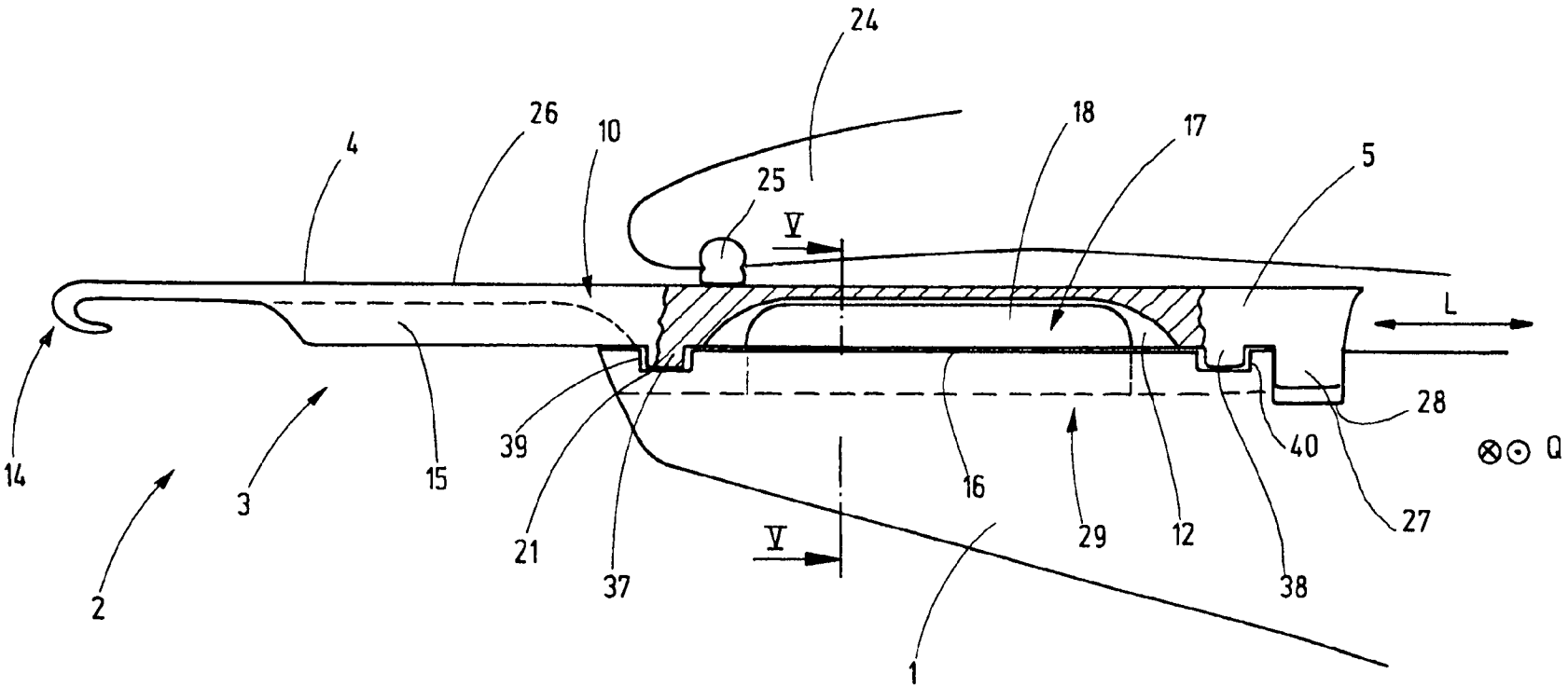
FIG. 11 is a sectional view in accordance with FIG. 4 of an alternative embodiment of the knitting tools and the bar.

FIG. 8 shows another modification. In this case, the positioning means 11 is represented by a preferably longitudinally extending rib 32 that projects from the lower narrow side 13 of the support section 5, said rib being narrower than the width of the support section 5 that is to be measured as the distance between the lateral surfaces 7, 8. The rib 32 comes into engagement with a groove 33 that is provided in the bar 1 and represents the fixing means 29. Again, the adjacent support sections of adjacent knitting tools 2 are arranged closely next to each other, leaving a minimal gap 9. FIGS. 9 and 10 show another modification of a knitting tool 2, again configured as a needle 3. Again, this needle has in its body 10 the slit 12 extending from the narrow side 13 and being used for positioning, said slit having a rounded bottom in the present case. Other than that, the previous explanations apply analogously. As is obvious from FIG. 10, the working section 4, as previously described, is narrower than the support section 5. The region of the hook 14 is again narrower. The center of the working section 4 is offset parallel with respect to the center of the support section 5. As a result of this, one lateral surface 7 is continuous while the lateral surface 8 may have a step marking the transition from the working section 4 to the support section 5. The slit 15 that is disposed to accommodate a slider for opening and closing the hook 14 may extend somewhat into the support section 5. It is of no consequence for positioning the knitting tool 2.

In the case of each of the above-described examples the working section 4 and the support section 5 are in alignment; however, it is pointed out that the sections are offset parallel with respect to each other not only in accordance with FIG. 10 but may also be arranged so as to be at an angle with respect to each other. The working section 4 may be swan-necked in any desired direction. The working section 4 of the knitting tool comprises the stitch-forming region of the knitting tool 2 and may have different lengths, depending on the application. One end of the stitch-forming region 4 comprises the end of the knitting tool 2 if it is configured as the needle 3, the hook 14; the other end of the stitch-forming region 4 may, depending on the application, end exactly at the border of the support section 5 or in said support section. The principle of positioning the knitting tools 2 without intermediate walls that would extend between the support sections 5 results in the aforementioned advantages, independent of the configuration of the working section 4.

In order to achieve a defined and improved positioning of the stitch-forming sections 4 of the knitting tools 2, this positioning may be uncoupled from the support surface 16 as well as from the strips 18. To achieve this, the knitting tool 2 may preferably be provided with feet 37, 38 only on its support section 5, said feet being used for the adjustment of a desired needle height. Said feet are preferably not used for axial positioning because this is done by foot 27. The feet 37, 38 extend into the grooves 39, 40 that are provided in the surface 16 of the bar 1 and that extend in said surface's longitudinal direction. The advantage of this embodiment is its high fabrication precision that can be achieved here with minimally complex fabrication. The metal cutting volume is minimal in the fabrication of the two grooves 39, 40. The wear of tools used in the fabrication of the grooves and hence the dimensional inaccuracy of the groove bottom are correspondingly low.

A knitting needle designed specifically for achieving particularly fine divisions, or another knitting tool 2, has a narrower working section 4 and a wider support section 5, whereby the support section 5 is provided with a positioning means 11, for example, having the form of a slit 12 or having the form of a rib 32. The knitting tool 2 is associated with a fixing means 29 in the form of a projection 17 or a groove 33 on the side of the bar 1. Due to this measure, the support sections 5 of the knitting tools 2 may be arranged—in close proximity to each other, in contact with or at a minimal distance from each other—on the bar 1, so that a maximum cross-section is available for configuring the support section 5. This provides strong stability for the knitting tools 2—even in cases of extremely fine divisions—and, at the same time, provides precise alignment and avoids division errors.

It will be appreciated that the above description of the present invention is susceptible to various modifications, changes and modifications, and the same are intended to be comprehended within the meaning and range of equivalents of the appended claims.

LIST OF REFERENCE NUMBERS

1 Bar
2 Knitting tools
3 Needle
4 Working section
5 Support section
Q Transverse direction
L Longitudinal direction
6 Intermediate space
7, 8 Lateral surfaces
9 Gap
T Division
10 Body
11 Positioning means
12 Slit
13 Narrow side, needle's upper side
13*a*, 13*b* Partial surfaces
14 Hooks
15 Slit
16 Support surface
17 Projection
18 Strip
19, 20 Flat sides
21 Groove
22, 23 Leg
24 Clamp strip
25 Damping element
26 Narrow side, needle's back side
27 Foot
28 Axial positioning groove
29 Fixing means
30 Projections
31 Narrow side, positioning surface
32 Rib
33 Groove
34 Step
35 Slit bottom
36 Narrow side
37, 38 Feet
39, 40 Grooves

What is claimed is:

1. Knitting tool for loading knitting machines comprising: a body having a stitch-forming section at one end and a support section, which is displaced from the stitch-forming section in a longitudinal direction of the body, by which the tool is supported on a tool mounting bar of a knitting machine, and a positioning means, disposed on a narrow side of the support section of the tool, for positioning the knitting tool on the tool mounting bar consistent with a pre-specified division, said positioning means is a rib that projects from and is narrower than said narrow side of the support section of the body and extends in the longitudinal direction of said body, whereby said rib can be inserted into a groove of a tool mounting bar, which groove is narrower than the support section of the knitting tool, to properly position the tool.

2. Knitting machine comprising a tool mounting bar for the accommodation and support of a plurality of knitting tools, each having a stitch-forming section at one end and a support section that is laterally displaced from the stitch forming section in the longitudinal direction of the body and by which the tool is supported on the tool mounting bar of the knitting machine, a positioning means , disposed on a narrow side of the support section of each tool and cooperating with a fixing means, disposed on the bar, for positioning the knitting tool on the bar consistent with a pre-specified division, said fixing means defining a needle division between adjacent tools supported on the bar, with said fixing means being shaped so as to be complementary to the positioning means.

3. Knitting tool in accordance with claim 2, wherein the positioning means is a slit provided in the support section of the body, said slit extending in the longitudinal direction of said body.

4. Knitting tool in accordance with claim 2, wherein the positioning means is a projection provided on the support section of the body.

5. Knitting tool in accordance with claim 2, wherein the positioning means is a rib provided on the support section of the body, said rib extending in the longitudinal direction of said body.

6. Knitting tool in accordance with claim 2, wherein the positioning means is provided on a narrow side of the support section of the body.

7. Knitting tool in accordance with claim 1, wherein the support section has a width that exceeds the width of the stitch-forming section.

8. Knitting tool in accordance with claim 1, wherein the body has a foot for longitudinal positioning of the knitting tool, said foot being in the vicinity of the positioning means.

9. Knitting tool in accordance with claim 2, wherein the positioning means is a cutout provided in the support section of the body.

* * * * *